US007256344B2

(12) United States Patent
Felisari

(10) Patent No.: US 7,256,344 B2
(45) Date of Patent: Aug. 14, 2007

(54) ELECTROTHERMAL DEVICE FOR IGNITION AND FLAME DETECTION IN GAS BURNERS

(76) Inventor: Dario Felisari, Via Comasina 123Bis, I - 20050 Verano Brianza, Milan (IT)

( * ) Notice: Subject to any disclaimer, the term of this patent is extended or adjusted under 35 U.S.C. 154(b) by 296 days.

(21) Appl. No.: 10/297,271

(22) PCT Filed: Jun. 8, 2001

(86) PCT No.: PCT/IB01/01800

§ 371 (c)(1),
(2), (4) Date: Jan. 7, 2003

(87) PCT Pub. No.: WO01/94846

PCT Pub. Date: Dec. 13, 2001

(65) Prior Publication Data

US 2003/0136439 A1 Jul. 24, 2003

(30) Foreign Application Priority Data

Jun. 9, 2000 (IT) ..... MI2000A1286

(51) Int. Cl.
*H01L 35/28* (2006.01)
*F23N 5/10* (2006.01)

(52) U.S. Cl. ..... 136/217; 136/220; 136/227; 136/230; 136/233; 137/66; 431/80

(58) Field of Classification Search ..... 136/217, 136/213, 220, 230, 227, 233, 228; 137/66; 431/80

See application file for complete search history.

(56) References Cited

U.S. PATENT DOCUMENTS

| | | | | |
|---|---|---|---|---|
| 3,070,645 A | | 12/1962 | Tracht | |
| 3,430,856 A | * | 3/1969 | Engelhard | 236/15 R |
| 3,650,154 A | * | 3/1972 | Arnett et al. | 374/181 |
| 4,203,779 A | * | 5/1980 | Kojima et al. | 136/233 |
| 4,207,053 A | | 6/1980 | Turner et al. | |
| 5,092,938 A | * | 3/1992 | Kanda et al. | 136/230 |
| 5,808,233 A | | 9/1998 | Finkel et al. | |

FOREIGN PATENT DOCUMENTS

| | | | |
|---|---|---|---|
| DE | 39 27 413 | | 2/1991 |
| FR | 2224751 | | 10/1974 |
| GB | 796874 | * | 6/1958 |
| JP | 62-272017 A | * | 11/1987 |

* cited by examiner

*Primary Examiner*—Nam Nguyen
*Assistant Examiner*—Anthony Fick
(74) *Attorney, Agent, or Firm*—Hedman & Costigan; James V. Costigan

(57) ABSTRACT

A single thermoelectric device designed to operate both as an igniter and flame detector for gas burners is described. Ignition is performed via heating, by Joule effect, of a conductor which can have, preferably, catalytic activity on the combustion while the flame is detected by means of a "hot" thermal state via the seeback effect. Both functions are obtained via control of a circuit for delivery of the power and detection and amplification of the electrical signal correlated to the flame.

11 Claims, 3 Drawing Sheets

ELECTROTHERMAL DEVICE FOR IGNITION AND FLAME DETECTION IN GAS BURNERS

The present invention concerns an electrothermal device for ignition and flame detection in gas burners.

More specifically, the present invention concerns an electrothermal device for ignition and continuous flame detection in burners that operate with natural gas (mainly methane-based), mains gas, LPG and similar.

As is known, automatic ignition of gas burners occurs by means of a voltaic arc between an electrical conductor element, appropriately powered, and the burner itself. Similarly, flame detection, if the burner accidentally goes out, is by means of a thermocouple which automatically stops the gas flow, via a solenoid valve, when it cools down due to the fact that it is no longer heated by the flame.

In traditional gas burners, therefore, whether they are burners for gas cookers, water heaters or boilers, the ignition and flame detection functions are controlled by two separate devices. This fact, in addition to being disadvantageous in itself as it requires the control of two devices, also has disadvantages connected with the arc ignition, such as electromagnetic emission (spark ignition systems are impulse radiation sources) and the risk of electrical shocks in the event of contact with the operator.

The aim of the present invention is to provide a device for ignition and flame detection for gas burners that does not have the disadvantages of the traditional devices described above.

This aim has been achieved by the applicant who has invented one single device for gas burners able to perform both ignition and flame detection when the flame accidentally goes out.

The subject of the present invention is therefore an electrothermal device for ignition and flame detection in gas burners which comprises a thermoelement including a pair of metal elements consisting of different metals, preferably with wire-type structure, welded together, each supported on a rheophore, said metal elements being able to generate thermoelectric voltages and currents when the junction is placed in an environment with temperature different from that of the rheophores, said thermoelement being able to ignite by the Joule effect the gas burner when the rheophores are connected to a source of electrical signals comprising, an electrical power source and impedance circuitry.

The metal elements used to produce the device subject of the present invention generally consist of circular section filaments with diameter between 0.1 and 0.8 mm. Alternatively, metal straps can be used with thickness between 0.1 and 0.8 mm and width between 2 and 0.5 mm. Said elements are supported on rheophores which are also metal, consisting of stainless steel or alloys such as brass and bronze, resistant to corrosion.

Any metal pair able to generate thermoelectric voltage and current, for example voltages above 0.03 volts or currents above 3 mA, when only the junction point is in contact with the gas flame, or generate heat by Joule effect can be used to produce this device. Examples of pairs of said metals are: platinum, platinum-rhodium, Chromel/Alumel.

Pairs of metals in which at least one of the metals has catalytic properties for oxidisation of the gas, such as platinum, palladium or nickel, are preferable. These pairs of metals are preferred as they permit lower gas ignition temperatures and longer duration of the materials or self-heating of the metal with consequent possibility of reducing the diameter of the metal elements since, once the surface catalysis temperature has been exceeded, the oxidisation (combustion) increases the temperature of the metal, rapidly enabling it to ignite the whole gaseous current.

Metal pairs able to generate only Joule effect, in which at least one of the metals is coated by a metal with catalytic surface properties for oxidisation of the gas, can also be used.

Alternatively, the electrothermal device for ignition and flame detection in gas burners can consist of a heating element in which the metal elements are replaced by a ceramic or ceramic-metal element in a solid or hollow cylindrical shape activated with metal powder with catalytic activity for oxidisation of the gas. This solution permits miniaturisation of the part of the present device in contact with the flame (hot spot).

The electrothermal device for ignition and flame detection in gas burners subject of the present invention is illustrated more clearly referring to the drawings of the attached figures which represent non-restrictive examples of embodiments.

With reference to the drawings of FIG. 1, the present device comprises (FIG. 1A) the two rheophores R1 and R2 which support the two metal elements A and B joined at point AB which is in contact with the flame F of the burner not illustrated.

Figure 1A:
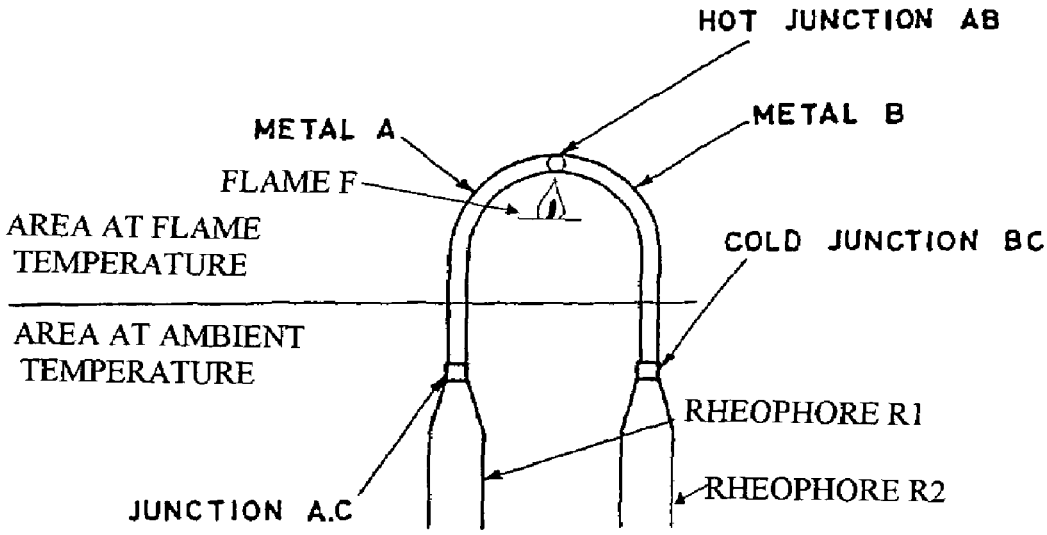
FIGS. 1B and 1C represent alternative forms of embodiment of the present invention in which the wire-type metal elements A and B are replaced by a ceramic or cermet element, either solid D1 or hollow D2.
Figure 1B:
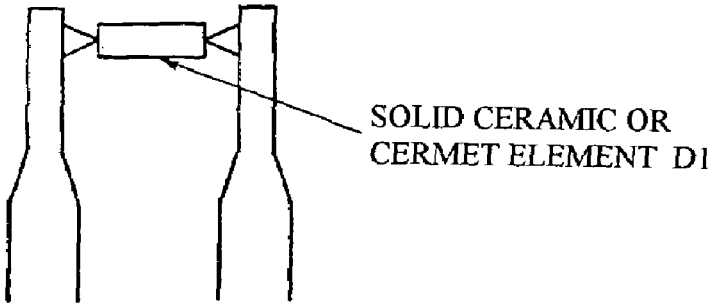
Figure 1C:
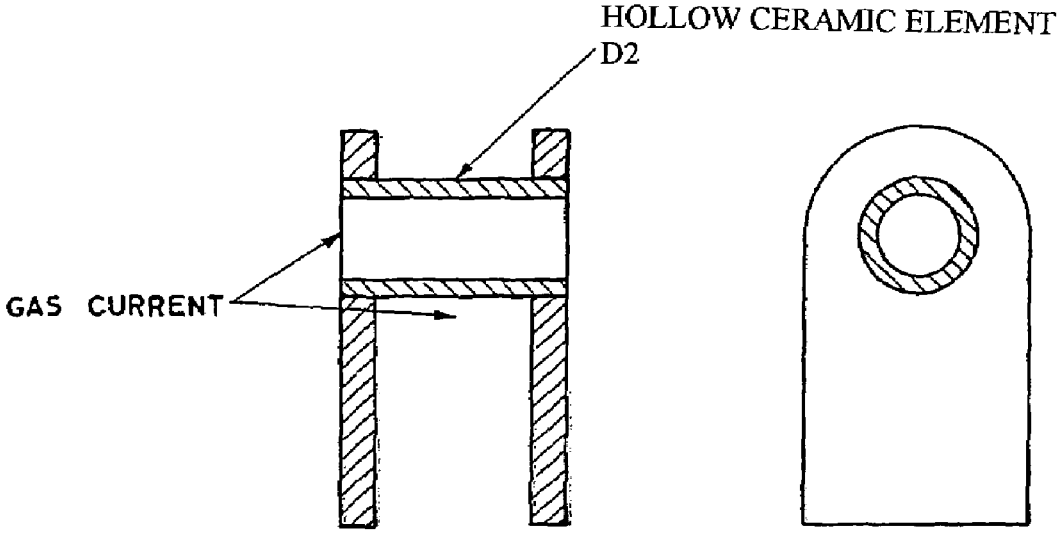
Figure 2A:
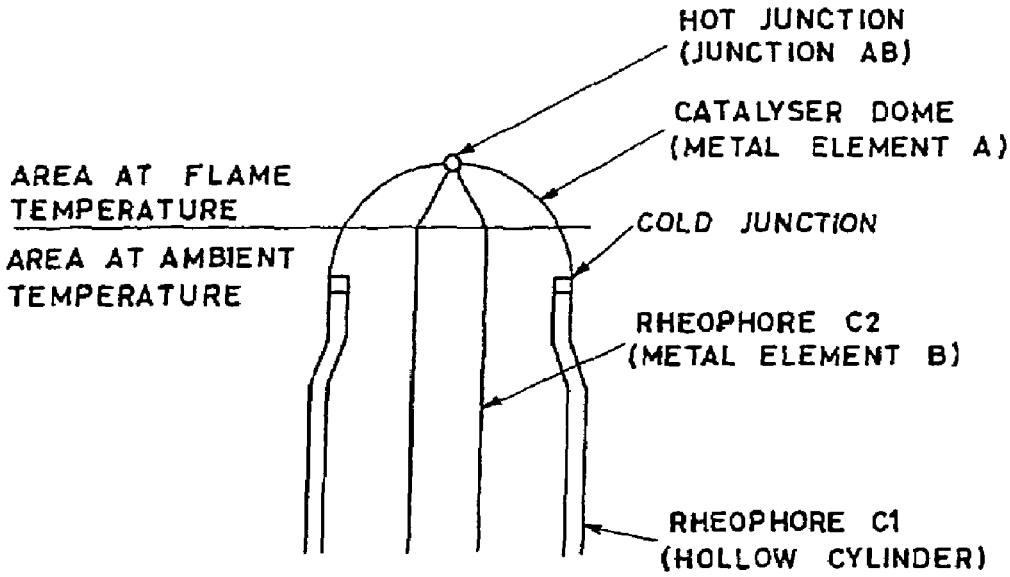
FIGS. 2A and 2B show further alternative forms of embodiment of the present invention.

FIG. 2A represents an alternative form of embodiment of the present invention in which one of the rheophores (C1) has a hollow, basically cylindrical or truncated cylindrical shape while the other rheophore (C2) is represented by a vertical bar coaxial with the first one. In this embodiment the metal element A supported on the hollow cylindrical-shaped rheophore has a dome structure containing the junction point AB with the metal element B supported on the coaxial rheophore.

Figure 2B:
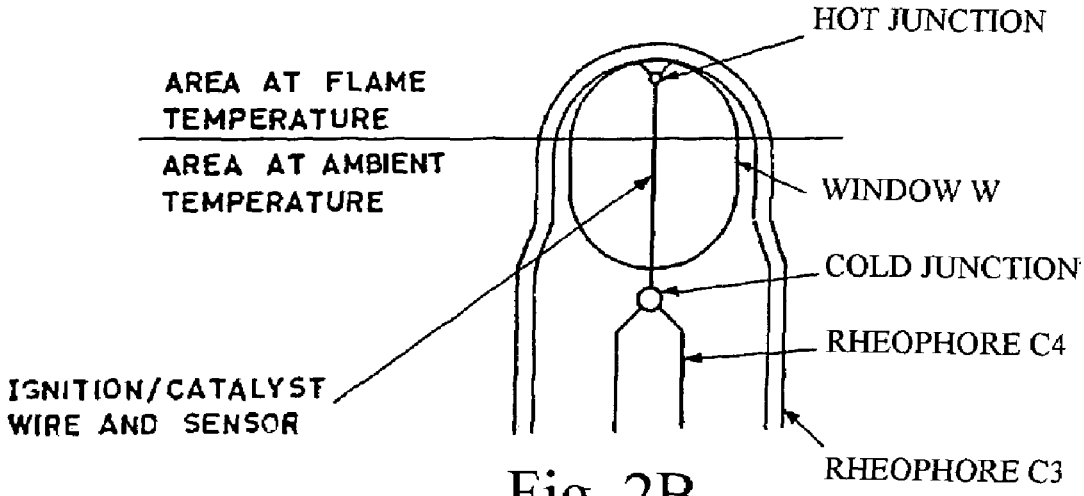

FIG. 2B represents an alternative form of embodiment of the present invention which shows an embodiment which is similar that of FIG. 2A but provided with window W in which the metal element Rheophore C3 forms a hot joint with the wire made of platinum (or similar catalyst) which is heated by the flame through the window W. The wire forms a cold junction with Rheophore C4.

Figure 3:
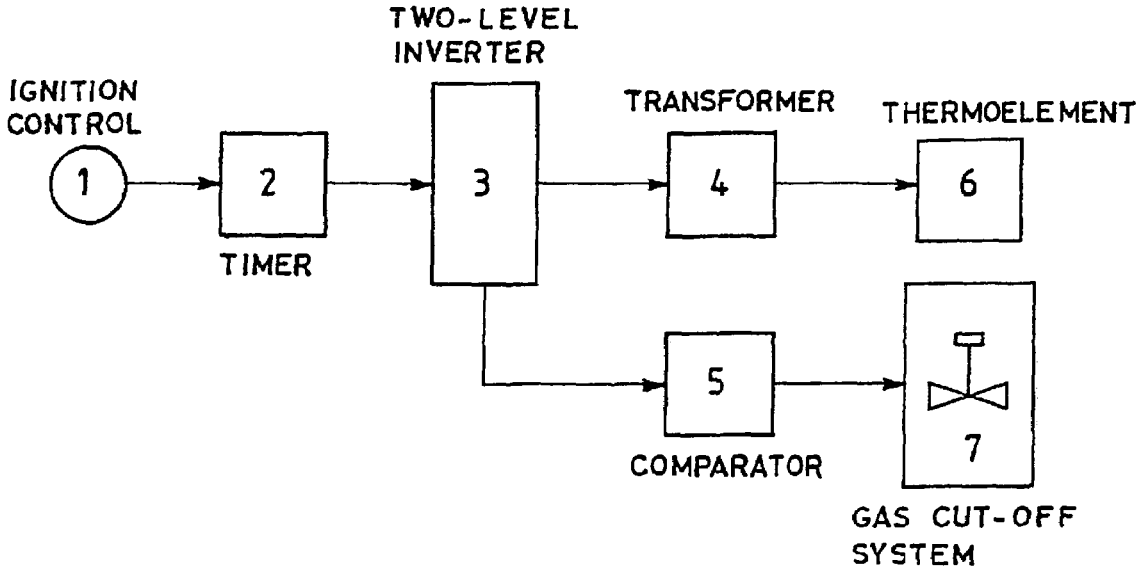

FIG. 3 represents a flow chart schematic of a low impedance circuit. The schematic shows a ignition control, timer and two-level inverter. The two-level inverter then sends 2 signals; one to a transformer and one to a comparator. The transformer then sends a signal to the thermoelement and the comparator sends a signal to a gas cut-off system.

Figure 4:
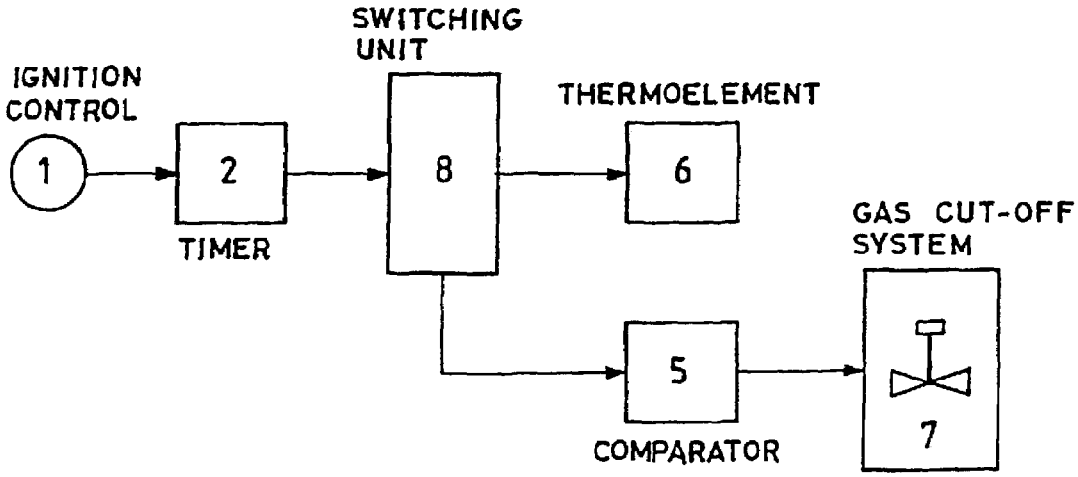

FIG. 4 represents a flow chart schematic of a high impedance circuit. The schematic shows an ignition control, timer and switching unit. The switching unit is capable of outputting a signal to either the thermoelement or the comparator. The comparator can send a signal to control the operation of a gas cut-off system.

An appliance for sparking ignition in a gas burner and continuously detecting the presence of the flame, functioning with the device subject of the present invention, can operate with a low impedance circuit, in the order of 10-1000 mΩ or with a high impedance circuit, in the order of 0.1-50 Ω.

In the case of a low impedance circuit, the appliance for sparking ignition and detecting the flame, illustrated in FIG. 3, comprises:

a. an ignition control unit 1;

b. a timer 2;

c. a two-level inverter 3 connected to the timer;

d. a transformer 4 and a comparator 5, connected to the outputs of the two-level inverter, and respectively connected to the ignition and flame detection device 6 and to a gas cut-off system 7.

When the ignition control unit 1 is activated, the timer 2 activates the inverter 3 at the highest level to transfer voltage to the transformer 4 and spark the ignition device (thermoelement) 6 which, simultaneously, is in contact with the gas to be ignited. Once the activation time is terminated, with ignition of the gas, the inverter reduces the level of power sent to the transformer, switching to the control level. In this phase, the flame is ignited and keeps the thermoelement junction AB at the required temperature, therefore producing a thermoelectric current. Following generation of the thermoelectric current, the impedance of the thermoelement is read and compared with a value in memory by means of the comparator 5. If the impedance value measured is the same as or above the one in memory, it means that the flame is ignited. When the impedance value measured drops, it means that the intensity of the thermoelectric current is dropping as a result of reduction in temperature of the thermoelement junction AB, due to extinguishing of the flame. This measurement activates the cut-off system 7 which blocks delivery of the gas.

In the case of a high impedance circuit, the equipment for sparking ignition and detecting the flame, illustrated in FIG. 4, comprises:

e. an ignition control unit 1;

f. a timer 2;

g. a switching unit 8 connected to the ignition and flame detection device 6; and h. a comparator 5, connected to a gas cut-off system 7.

The equipment for sparking ignition and detecting the flame operates as in the previous case except that a switching unit is used instead of the inverter/transformer unit. Once the activation time has elapsed, the switching unit 8 detects the electromotive force at the ends of the thermoelement 6, comparing it with the reference value. If the above electromotive force is below the reference value, the comparator activates the gas cut-off system which blocks delivery of the gas.

The electrothermal device for ignition and flame detection in gas burners subject of the present invention offers the following advantages:

- no electromagnetic emission (spark ignition systems are impulse radiation sources);
- virtually immediate flame detection (low response time from thermoelement);
- no electrical shocks in the event of contact with the operator;
- no noise during ignition;
- immediate ignition (given the energy available for activation);
- presence of one single element able to perform both ignition and flame control;
- possibility of forming the hot spot on a point of the device which cannot come into contact with the operator;
- central control of several burners by connection to a control unit which also controls gas supply cut-off;
- possibility of detecting accidental gas leakage permanently and on several burners.

The invention claimed is:

1. Electrothermal device for ignition and flame detection in a gas burner which comprises a thermoelement, including a pair of joined metal elements, each one supported on a respective rheophore, said metal elements being able to generate thermoelectric voltages and currents when the junction is placed in an environment with temperature different from that of the rheophores, said thermoelement igniting the gas burner by the Joule effect when the rheohpores are suitably connected to an electrical energy source and impedance circuitry.

2. An electrothermal device according to claim 1, in which the metal elements consist of circular section filaments with diameter between 0.1 and 0.8 mm.

3. An electrothermal device according to claim 1, in which the metal elements consist of metal straps with thickness between 0.1 and 0.8 mm and width between 2 and 0.5 mm.

4. An electrothermal device according to claim 1, in which the metal elements are supported on the respective rheophores which are also metal, consisting of stainless steel or alloys resistant to corrosion.

5. An electrothermal device according to claim 1, in which the pair of metal elements generates voltages above 3 mV or currents above 3 mA when only a junction point is in contact with the gas flame.

6. An electrothermal device according to claim 1, in which at least one of the metals of the pair of metal elements has catalytic surface properties for oxidization of the gas.

7. An electrothermal device according to claim 1, comprising metal pairs able to generate only Joule effect in which at least one of the metals is coated with a metal that has catalytic surface properties for oxidization of the gas.

8. An electrothermal device according to claim 1, in which each metal element comprises a ceramic or ceramic-metal element in a solid or hollow cylindrical shape mixed or coated with metal powder with catalytic activity for oxidization of the gas.

9. An electrothermal device as in claim 1, in which said ignites thermoelement a gas burner and continuously detects presence of a flame.

10. An appliance for sparking ignition in a gas burner and continuously detecting presence of a flame comprising an electrothermal device as in claim 9, and impedance circuitry, wherein the impedance circuitry includes a low impedance circuit which comprises: an ignition control unit (1); a timer (2); a two-level inverter (3) connected to the timer; a transformer (4) and a comparator (5), which are connected to outputs of the two-level inverter, said transformer (4) is further connected to the electrothermal device, and said comparator is able to control the operation of a gas cut-off system (7).

11. An appliance for sparking ignition in a gas burner and continuously detecting presence of a flame comprising an electrothermal device as in claim 9, and impedance circuitry, wherein the impedance circuitry includes a high impedance circuit which comprises: an ignition control unit (1) which is connected to a timer (2), said timer outputs a signal to a switching unit (8) which can output a signal to the electrothermal device; and a comparator (5), said comparator is able to control the operation of a gas cut-off system (7).

* * * * *